United States Patent [19]

Fleckles et al.

[11] Patent Number: 4,841,899

[45] Date of Patent: Jun. 27, 1989

[54] KAYAK, FOLDING

[76] Inventors: Logan N. Fleckles; Karen Fleckles, both of 576 S. Arlington Ave., Des Plaines, Ill. 60016

[21] Appl. No.: 175,300

[22] Filed: Mar. 30, 1988

[51] Int. Cl.[4] ..... B63B 35/71

[52] U.S. Cl. ..... 114/347; 114/66; 114/353

[58] Field of Search ..... 114/347, 352, 353, 354, 114/359, 66

[56] References Cited

U.S. PATENT DOCUMENTS

| | | | |
|---|---|---|---|
| 3,437,067 | 4/1969 | Malin | 114/66 |
| 3,869,743 | 3/1975 | Brown et al. | 114/354 |
| 4,057,865 | 11/1977 | Trautwein | 114/347 |
| 4,227,272 | 10/1980 | Masters | 114/347 |
| 4,274,170 | 6/1981 | Simpson | 114/354 |

FOREIGN PATENT DOCUMENTS

| | | | |
|---|---|---|---|
| 2572050 | 4/1986 | France | 114/347 |
| 610710 | 6/1978 | U.S.S.R. | 114/347 |

*Primary Examiner*—Sherman D. Basinger
*Assistant Examiner*—Stephen P. Avila
*Attorney, Agent, or Firm*—Paul H. Gallagher

[57] ABSTRACT

A frame made up of structural pieces (wooden) and hardware pieces interconnecting them, and a flexible hull. The frame includes a main frame and coaming. The main frame is separable transversely at the middle, and each half thus formed is insertable into one end of the hull which is drawn taut over the frame half, after which the coaming is applied to the main frame and the hull secured thereto. The frame is made up of a plurality of relatively short pieces that are separable or foldable to enable them to be put in correspondingly short bundles, for carrying purposes. The hardware pieces include, at the ends, strips on the stem pieces having recesses and hook elements, and hooks on the gunwales, and one ridge rail hooked in the recesses; connectors interconnecting parts of the gunwales including plates on adjoining parts having interfitting hooks and plates interfitting in face-to-face relation and held in such by cross ribs of the frame; telescoping connectors in the chines, one of which has an interlocking pin dimensioned and confined against the hull bearing thereon; brackets on certain ribs for securing the hull to the coaming. Also of two backrests, one is adjustable; packs are detachably mounted in the frame within the hull, that are flexible and adapted to be carried on a person's back. The hull is transparent forming a "glass bottom" and the floor boards have transparent portions in register with the glass bottom.

28 Claims, 8 Drawing Sheets

KAYAK, FOLDING

FIELD OF THE INVENTION

The invention resides in a folding kayak having a frame covered by a hull. The frame is typically wooden, made up of spaced pieces detachably connected together, and the hull is a continuous flexible member of material such as plastic, rubberized sheet, or cloth, fitted tight over the frame. The kayak is broad at the beam, and it tapers to sharp dimensions at the bow and stern. The frame is separable transversely at the beam, forming front and rear end sections. The end sections are individually fitted in the corresponding ends of the hull, and the tapered shape of the frame and hull enable the sections to be forced into the hull, producing a wedging effect and consequent tight fitting of the hull to the frame. In the final phase of fitting the sections in the hull, certain of the frame pieces are flexed inwardly away from their final generally straight position, then fitted end-to-end together, and pried outwardly to their final positions, producing a toggle effect and forcing the frame sections tightly into the hull.

OBJECTS OF THE INVENTION

The main object of the invention is to provide a novel folding kayak having the following features and advantages:

1. The pieces of the frame have simple and unusually effective means for detachably and releasably connecting them together.

2. The kayak is easy to assemble, being especially adapted to being assembled by one person in a short period of the time.

3. The kayak is sufficiently large to accommodate two persons and is specifically designed to be occupied by one person, or two persons, selectively, accommodating selective positional seating of the person(s) so as to eliminate imbalance of the kayak regardless of the number of persons occupying it.

4. It has great stability, both initial and secondary, and is designed primarily to be a high performance water craft which also is foldable for storage, as opposed to a primarily foldable boat the hull configuration of which is compromised to accommodate the foldability.

5. It includes stowage bags and the frame is especially constructed to accommodate the stowage bags in a novel and convenient manner.

6. As an alternative to an opaque hull, a transparent hull is offered for a "glass bottom" effect.

DESCRIPTION OF A PREFERRED EMBODIMENT

Figure 13:
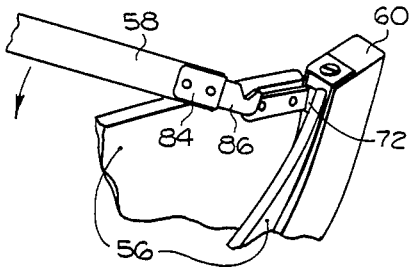
FIG. 13 is a fragmentary perspective view showing a step of applying the ridge rail at the rear end of the frame.
Figure 13A:
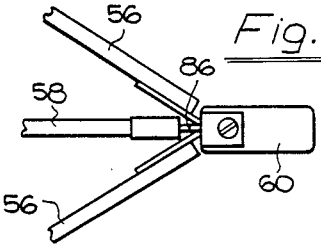

FIG. 13*a* is a top view of the elements of FIG. 13, after the ridge rail is put in place.

Figure 14:
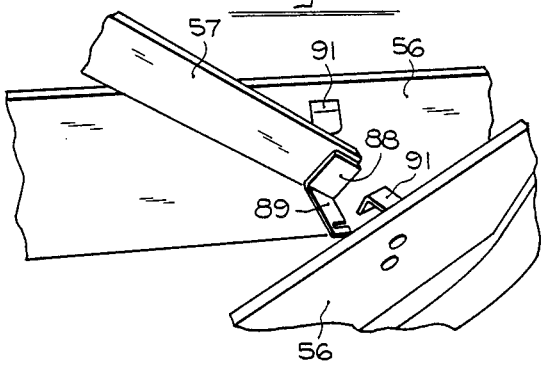

FIG. 14 is a fragmentary perspective view showing a step of applying the ridge rail at the front end of the frame.

Figure 15:
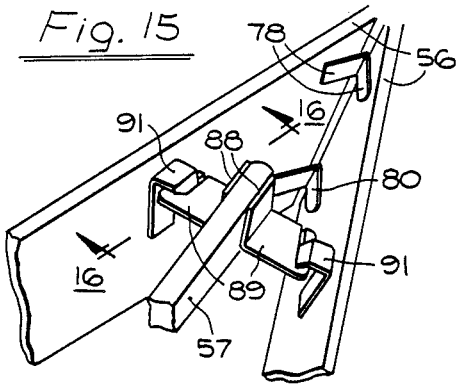

FIG. 15 is a view from the top of FIG. 14, after the ridge rail is connected.

Figure 16:
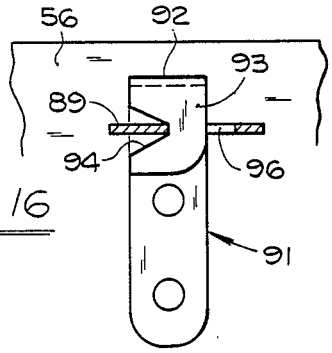

FIG. 16 is a fragmentary sectional view taken at line 16—16 of FIG. 15.

Figure 17:
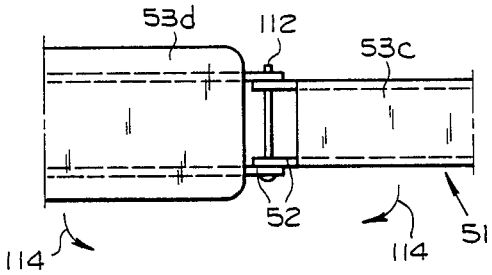

FIG. 17 is a fragmentary top view of the keel.

Figure 18:
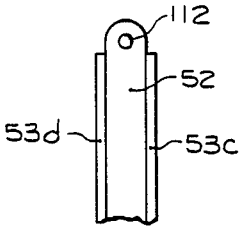

FIG. 18 is a side view of the portion of the keel of FIG. 17 in folded position.

Figure 19:
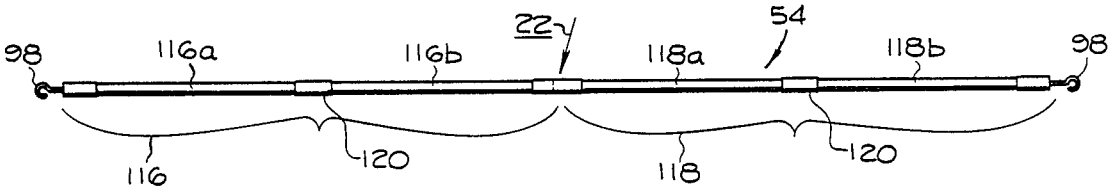

FIG. 19 is a side view of a chine.

Figure 20:
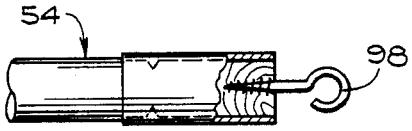

FIG. 20 is a large scale view, partially in section, of the end portion of a chine.

Figure 21:
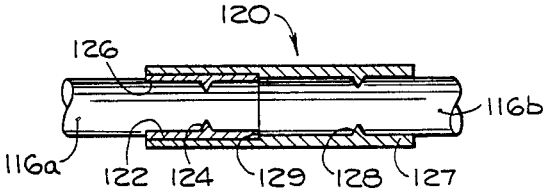
Figure 22:
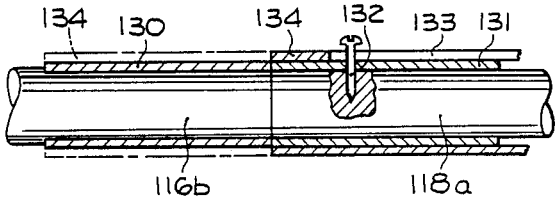

FIG. 21 is a large scale sectional view of a connection between adjacent chine pieces. FIG. 22 is a large scale sectional view of the central connection of the half-lengths of a chine.

Figure 3:
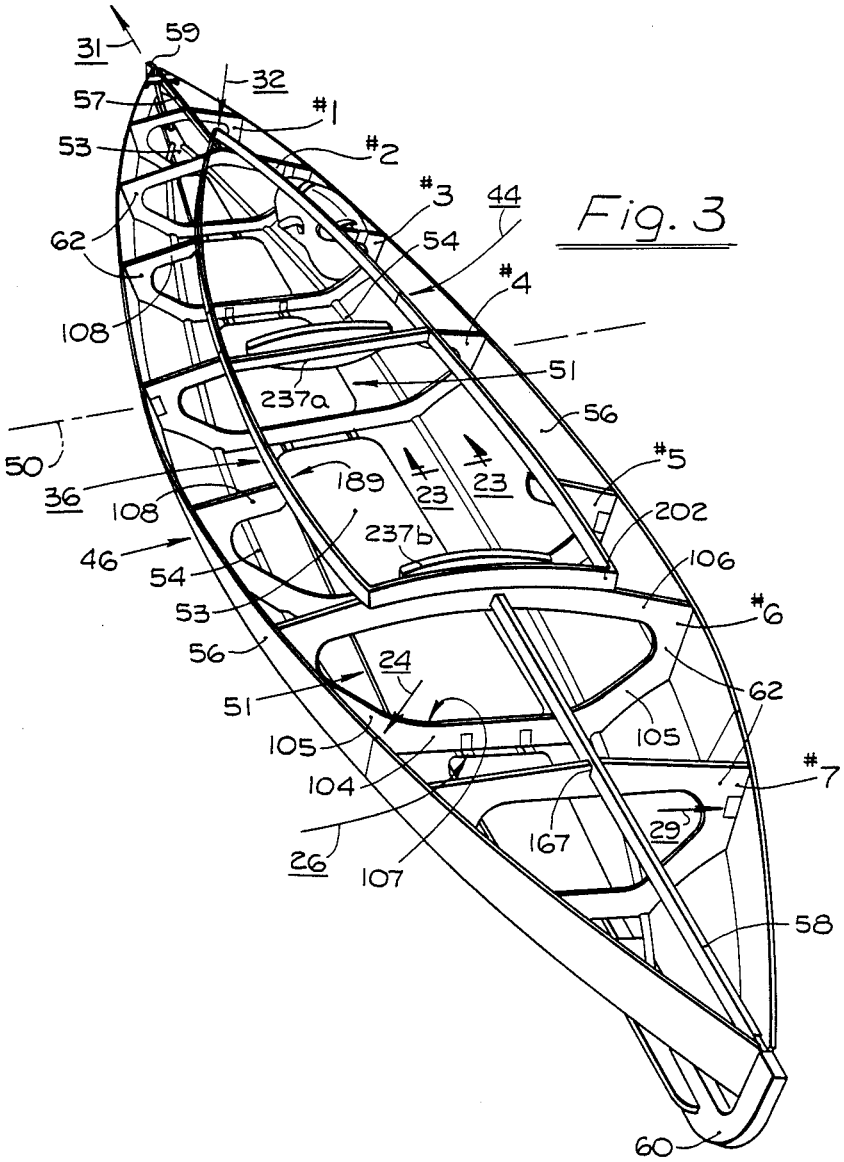
FIG. 3 is a perspective view of the frame of the kayak, without the hull, taken from the rear, and above.
Figure 23:
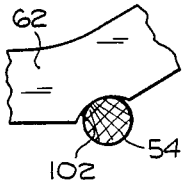

FIG. 23 is a cross sectional view taken at line 23—23 of FIG. 3 (middle).

Figure 24:
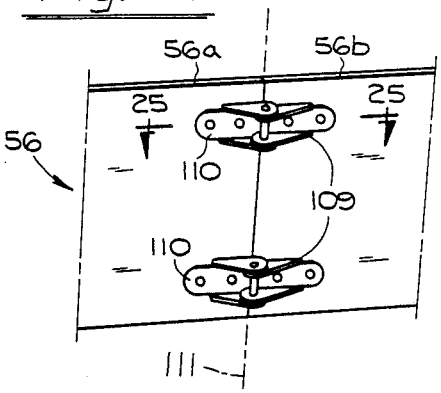

FIG. 24 is a detail view taken approximately at the position indicated by the arrow 24 in FIG. 3 (lower left).

Figure 25:
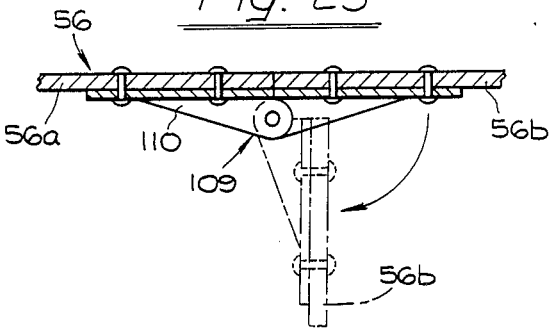

FIG. 25 is a sectional view taken at line 25—25 of FIG. 24 and showing one of the parts in a folded angular position in dot-dash lines.

Figure 26:
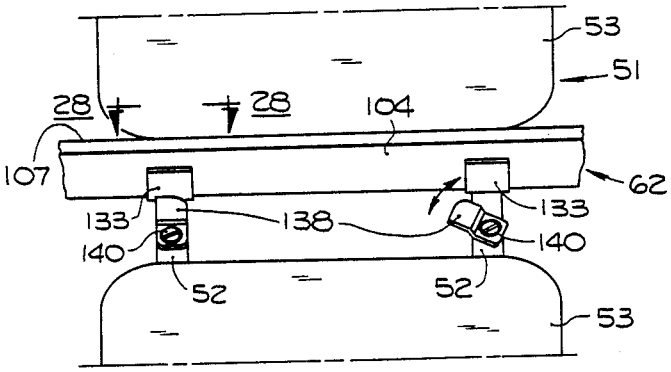

FIG. 26 is a fragmentary perspective view oriented substantially as indicated by the arrow 26 in FIG. 3 (lower left), but looking forwardly and downwardly at an angle.

Figure 27:
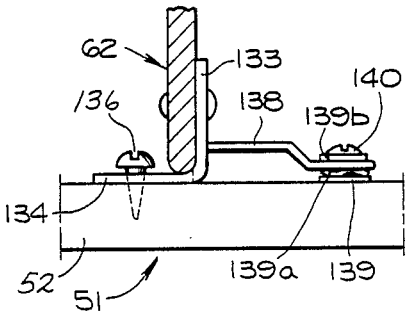
Figure 28:
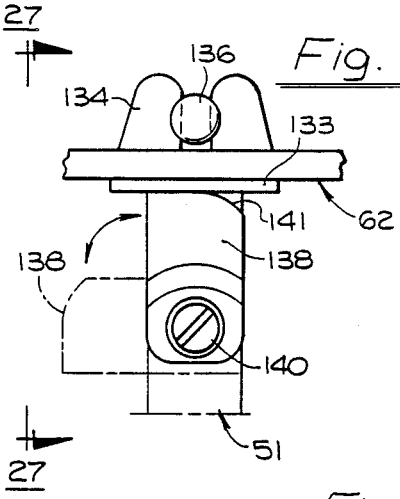

FIG. 27 is a sectional view taken at line 27—27 of FIG. 28.

FIG. 28 is a fragmentary detail view looking downwardly substantially at the line 28—28 of FIG. 26.

Figure 29:
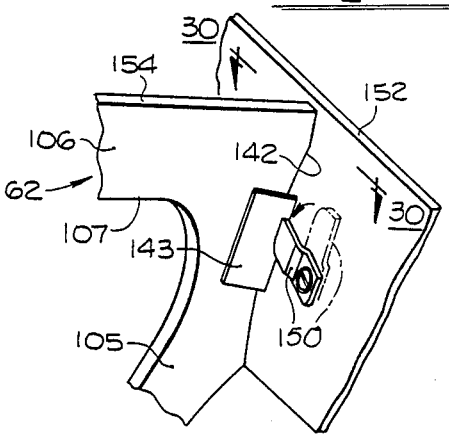

FIG. 29 is a fragmentary perspective view showing the connection between a rib and gunwale, at any of the various such connections, as represented by the arrow 29 of FIG. 3 (lower right).

Figure 30:
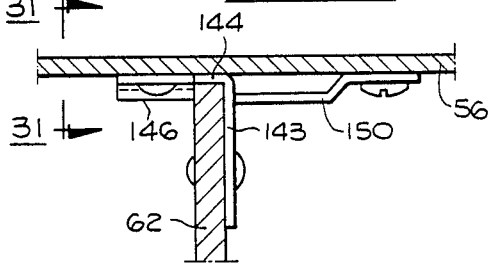

FIG. 30 is a view taken at line 30—30 of FIG. 29.

Figure 31:
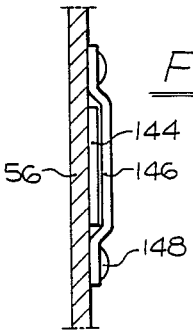

FIG. 31 is a view taken at line 31—31 of FIG. 30.

Figure 32:
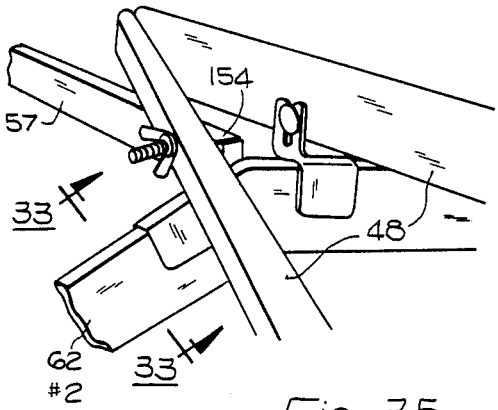

FIG. 32 is a fragmentary perspective view taken at the arrow 32 of FIG. 3 (top right).

Figure 33:
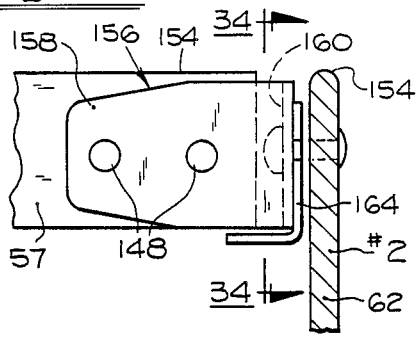

FIG. 33 is a view taken at line 33—33 of FIG. 32.

Figure 34:
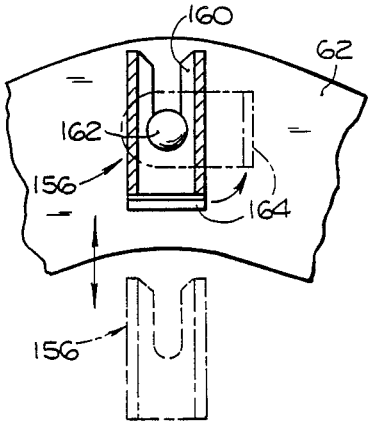

FIG. 34 is a fragmentary view taken at line 34—34 of FIG. 33.

Figure 6:
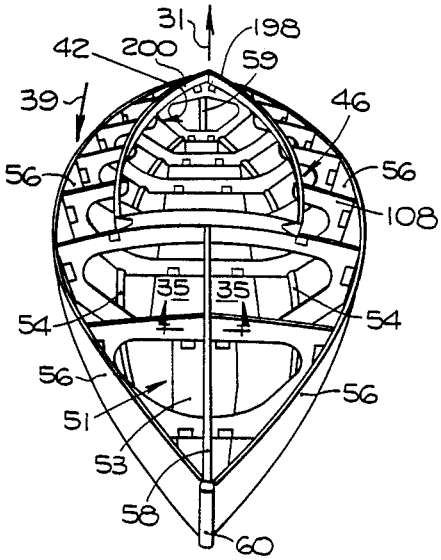
FIG. 6 is a perspective view of the frame taken directly longitudinally forwardly and from an elevated position.
Figure 35:
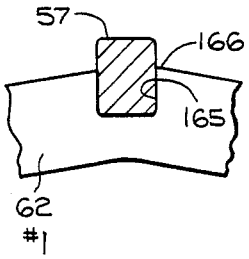

FIG. 35 is a view taken at line 35—35 of FIG. 6.

Figure 36:
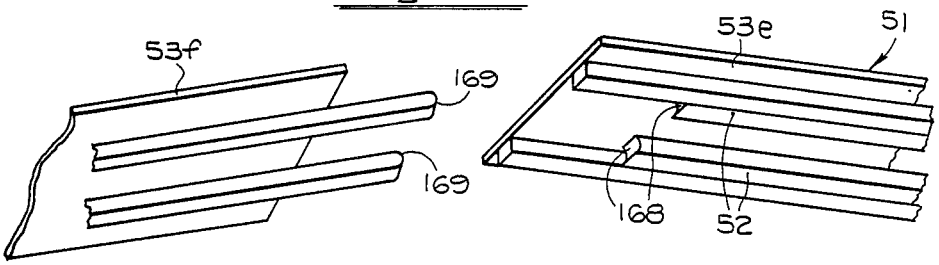

FIG. 36 is a perspective view, oriented according to arrow 36 of FIG. 3 (middle left), of the underside of the adjacent half-lengths of the keel, showing a step of interconnecting them.

Figure 37:
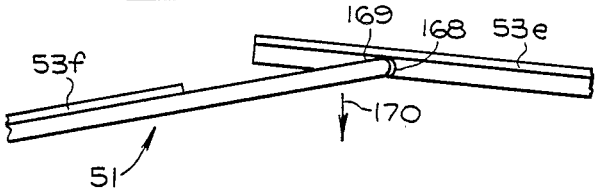

FIG. 37 is a side view of FIG. 36 showing a further step in interconnecting the parts.

Figure 38:
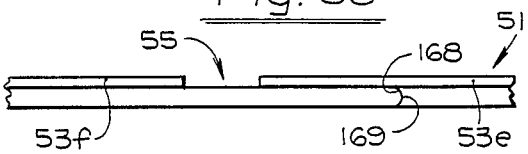

FIG. 38 is a view of the parts of FIG. 37 in final connected position.

Figure 39:
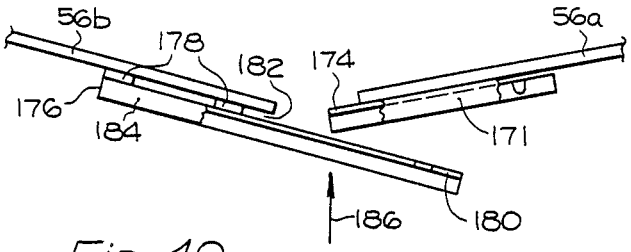

FIG. 39 is a view oriented at about the arrow 39 of FIG. 6 showing a step in connecting adjacent gunwale half-lengths.

Figure 40:
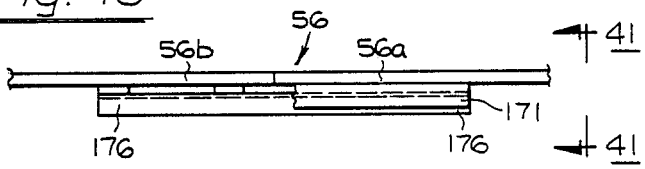

FIG. 40 is a view of the elements of FIG. 39 in fully connected position.

Figure 41:
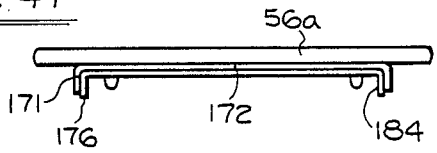

FIG. 41 is a view taken at line 41—41 of FIG. 40.

Figure 42:
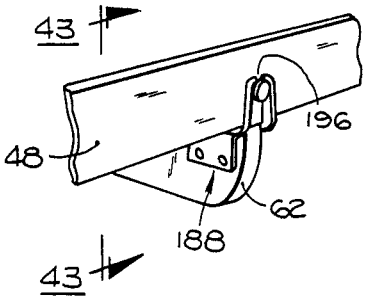

FIG. 42 is a fragmentary perspective view showing a coaming piece in connected position oriented according to the arrow 42 of FIG. 6.

Figure 43:
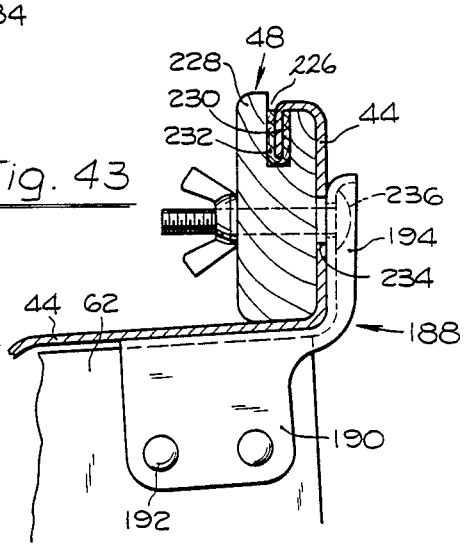

FIG. 43 is a sectional view taken at line 43—43 of FIG. 42.

Figure 44:
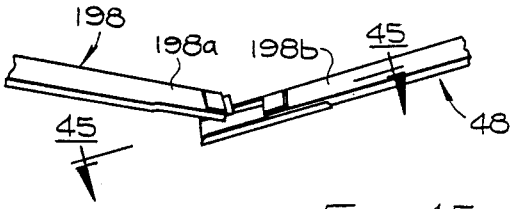

FIG. 44 is a fragmentary view, at an angle, of adjacent parts of a coaming piece in a step connecting them together, at about the position of the arrow 44 of FIG. 3 (upper right).

Figure 45:
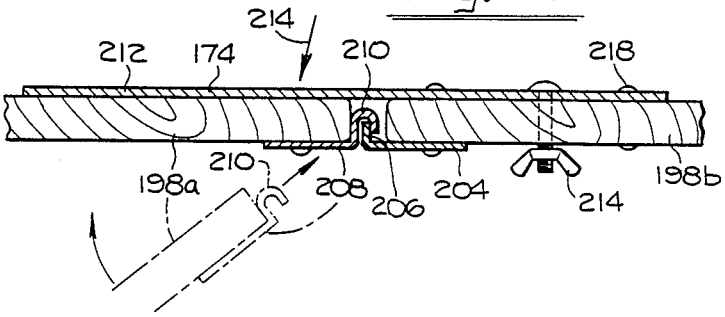

FIG. 45 is a sectional view oriented according to line 45—45 of FIG. 44 showing the coaming pieces in connected position.

Figure 46:
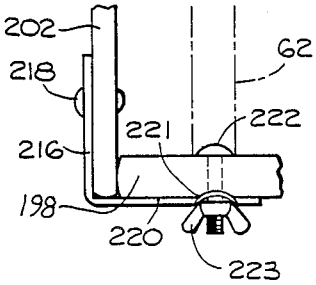

FIG. 46 is a fragmentary view looking downwardly at the point indicated by the arrow 46 in FIG. 6, showing the rear, and a side, coaming pieces connected together.

Figure 2:
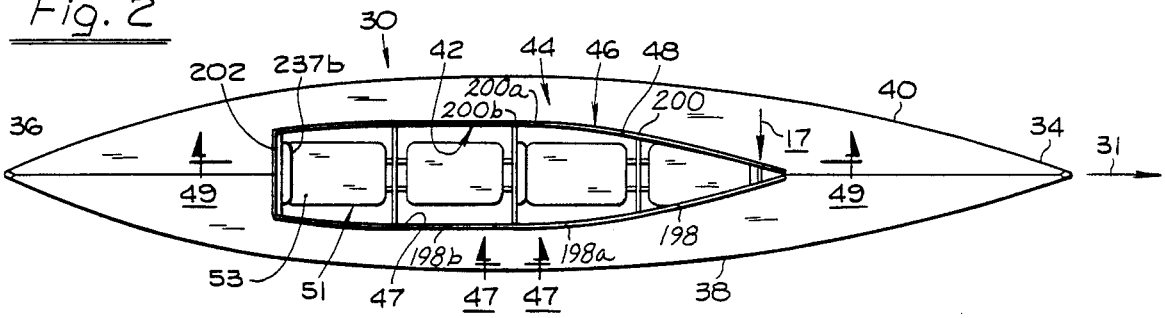
FIG. 2 is a top view.
Figure 47:
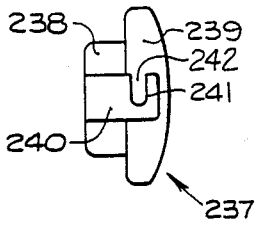

FIG. 47 is a fragmentary end view of a backrest, taken at line 47—47 of FIG. 2.

Figure 48:
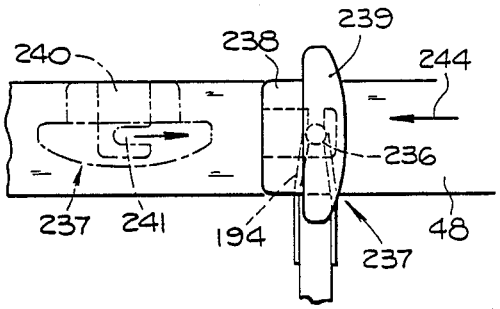

FIG. 48 is a view oriented similarly to FIG. 47, and including the content of FIG. 47, but showing a step in mounting the backrest in the frame.

Figure 49:
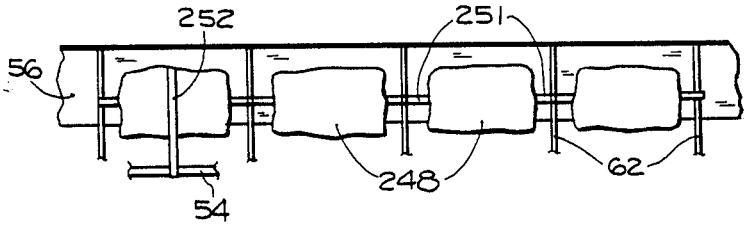

FIG. 49 is a view taken at line 49—49 of FIG. 2, showing the pack bags or stowage bags mounted in the kayak.

Figure 49A:
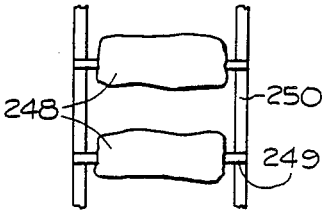

FIG. 49*a* is an illustration of the stowage bags mounted on a person's back.

Figure 50:
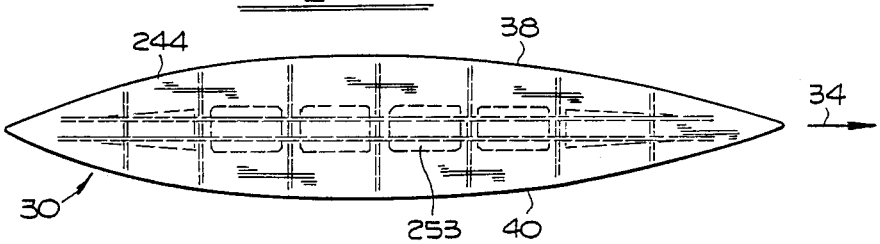

FIG. 50 is a bottom view of a different embodiment, including a transparent bottom.

Figure 51:
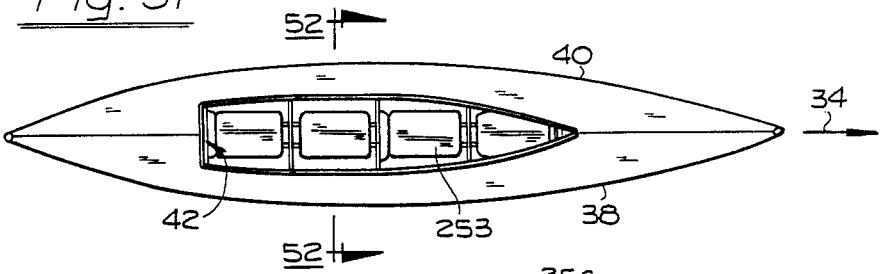

FIG. 51 is a top view of the embodiment of FIG. 50, showing transparent floor boards.

Figure 52:
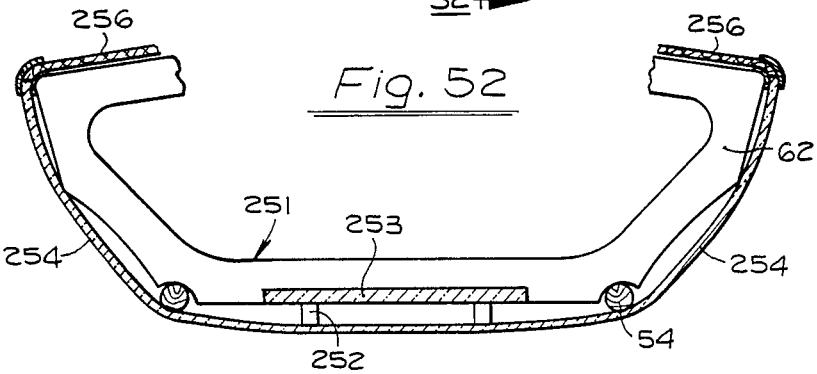

FIG. 52 is a sectional view taken at line 52—52 of FIG. 51.

Figure 1:
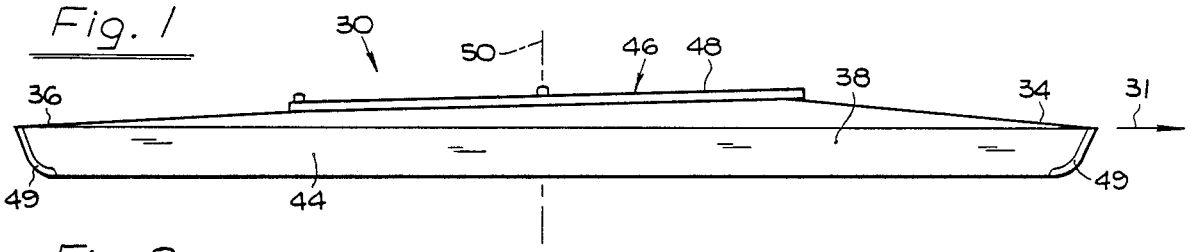
FIG. 1 is a side elevational view of the kayak of the invention, from the starboard side.

Referring in detail to the drawings, and particularly FIGS. 1 and 2, the folding kayak of the invention is indicated in its entirety at 30, and FIG. 1 shows the starboard side in elevation. In various ones of the figures, an arrow 31 is applied, for convenience, to indicate the direction of movement, and thus orientation of the kayak. The kayak includes a bow 34, a stern 36, a starboard side 38, and a port side 40. It has a cockpit or hatch 42 for accommodating the passengers, the kayak being designed, as will be referred to hereinbelow, to accommodate either one or two passengers.

The folding kayak includes a hull 44 and a main frame 46. The frame is indicated only fragmentarily in FIGS. 1 and 2, but shown in its entirety in FIGS. 3 and 6.

The hull 44 is made of suitable material, such as plastic, rubberized sheet, or canvas, that is relatively heavy, and flexible. The hull includes two main parts, one below the water line, and the other, the deck, above the water line. The parts are sewn or fused together and sealed, forming a unitary and effectively integral hull. At its ends, the hull includes rubberized cushioning 49 serving as bumpers, and aiding in sealing the adjacent edges of the material making up the hull. The hull has an opening 47 for insertion of the parts of the frame thereinto, and which accommodates the cockpit 42 in the frame.

The frame 46 as will be described in detail hereinbelow, includes separate sections detachably and releasably secured together at a transverse line 50, FIGS. 1 and 3, thus forming a front section 46A (FIGS. 4 and 5) and a rear section 46B. The kayak includes coaming 48 which is part of the frame, but it does not enter into forming the main frame sections 46A, 46B. In assembling the kayak, the sections are set up individually, without securing the two sections together, and individually inserted into the hull. After the two sections are individually set up or assembled, one of them, such as the front section 46A is inserted through the opening 47 into the front end of the hull. It is driven in tightly, or rammed into place, so that the tip of the frame engages, or nearly engages, the far end inner surface of the hull.

Figure 5:
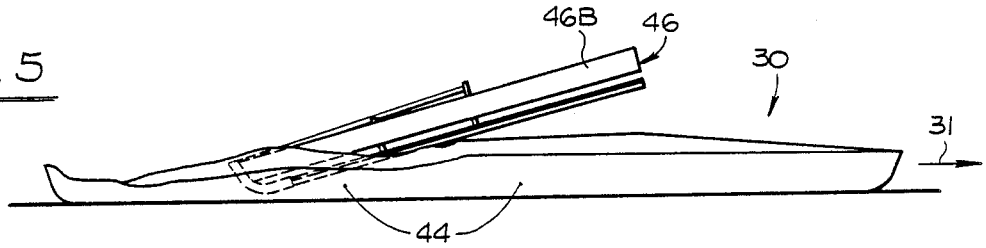
FIG. 5 is a view similar to FIG. 4, but showing the front end section of the frame in place and inserting the rear end section of the frame in the hull.

After the front section is so inserted in place, the rear section 46B is then inserted. In FIG. 5, the front end of the hull 44 is shown in full explanded position, indicating that the front section of the frame is in place therein. Then the rear section 46B is inserted into the rear portion of the hull, in a manner similar to that of the front section. When the two sections are so put in place in the hull, they normally do not expand the hull to the utmost, because of the limited strength of a person, but as will be referred to in detail hereinbelow, a greater force is applied to the frame sections to force them into their final position by securing corresponding pieces of the frame sections together, which produces a toggle effect, providing the necessary great force for so ramming the sections into position, and in applying this great force, the corresponding pieces of the two frame sections are moved into respective alignment.

Figure 8:
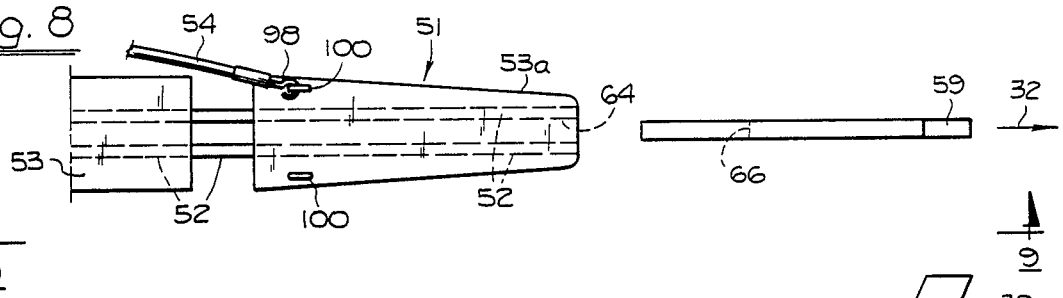
FIG. 8 is an exploded view, from above, of one end of the keel and the stem piece to be connected therewith.

Reference is made next to FIGS. 3, 6, and 8, in reference to which the pieces of the frame are individually identified. These various pieces include the keel 51 which includes a pair of keel elements, or keelson, 52, on which are floor boards 53, the latter having spaces 55 therebetween. Outwardly and upwardly from the keel are chines, or chine pieces, 54, and upwardly from the chines are gunwales 56. The frame also includes ridge rails 57, 58, at the top.

Mounted on the ends of the keel are stem pieces 59, 60, and the chines and gunwales, and one ridge rail, are secured at their ends to the respective ones of these stem pieces.

A plurality of ribs 62 (seven) are included in the framework, these ribs being individually identified #1, #2, etc., from front to rear. The chines 54, gunwales 56, and keel 51, are secured to the ribs, as will be described in detail hereinbelow.

The structural pieces of the frame are preferably of wood, and the connector pieces connecting them together are of brass, or stainless steel, or equivalent materials.

The chines 54 co-act with the keel and floor boards to form the effective bottom of the frame and thus the shape of the kayak below the water line; the chines are placed at positions transversely of the kayak to provide a relatively wide or narrow profile, respectively. Additionally the ribs 62 are shaped relative to the intended shape of the kayak, and are proportioned at the bottom so that the chines will be located in the frame assembly at relatively higher or lower positions. Thus the keel, chines, ribs, and gunwales, provide the main shape of the kayak, as viewed in transverse section.

Figure 4:
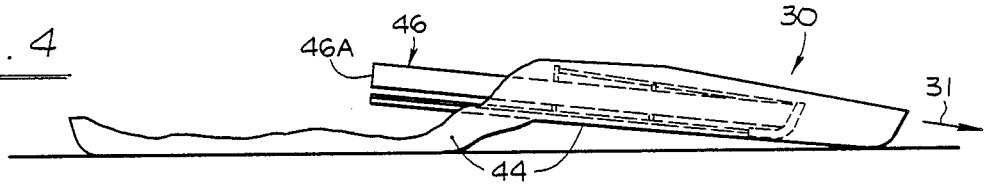
FIG. 4 is a side elevational view showing a step in applying the hull to the frame, indicating insertion of the front end section of the frame into the hull.
Figure 7:
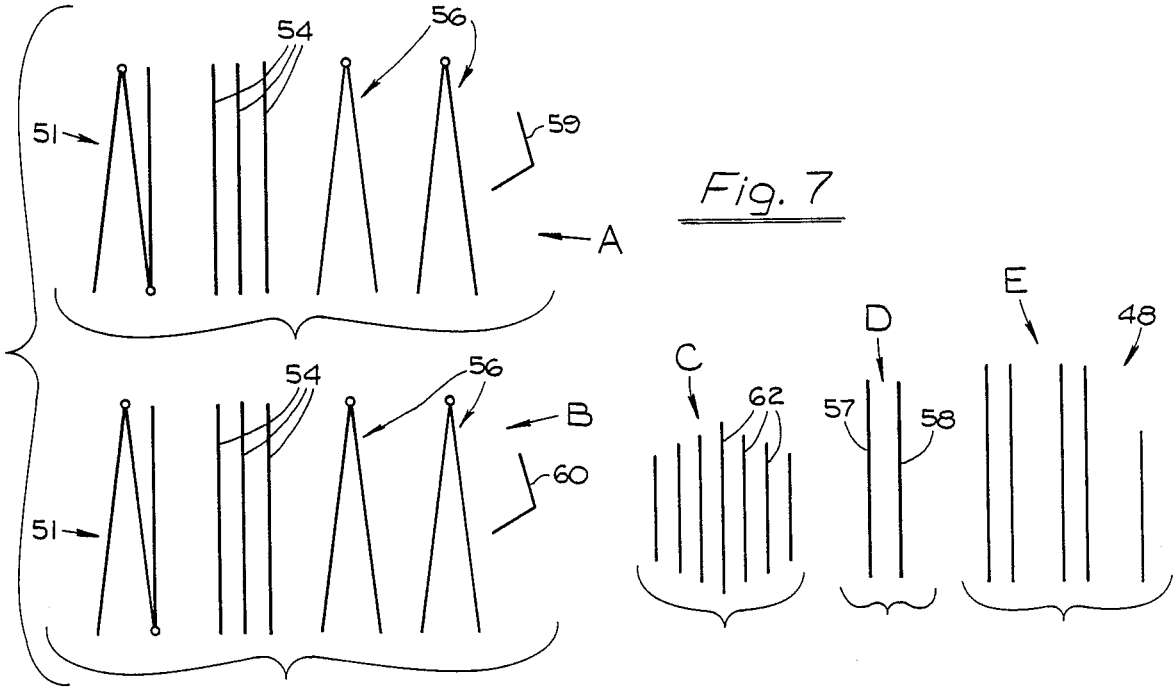
FIG. 7 is a diagrammatic illustration, including in simple lines, the pieces making up the frame, minus the metal connector pieces.

FIGS. 3 and 6 show the frame in its entirely; FIGS. 4 and 5 together show the front and rear sections into which the majority of the main frame is separable. The two sections, and thus the main frame, are made up of individual pieces and in certain cases those in each section may be referred as to half-lengths. In certain instances, the pieces of a half-length are hinged together. FIG. 7 shows the various pieces into which the frame is separable. In the latter figure, the group indicated A includes those pieces from the front section 46A; the group B includes the corresponding pieces from the rear section; the group C includes all the ribs; the group D includes the ridge rails; and the group E the pieces of the coaming. For convenience the pieces of the frame include what are referred to as longitudinal pieces, and ribs, which are transverse, and coaming.

In this figure, the pieces making up the frame are shown in diagrammatic form, including mostly straight lines, for ease in quickly identifying the various elements and components. This figure also shows the approximate relative sizes of the various pieces, showing the knockdown condition for packing and carrying. The hull is not included in this figure.

Figure 9:
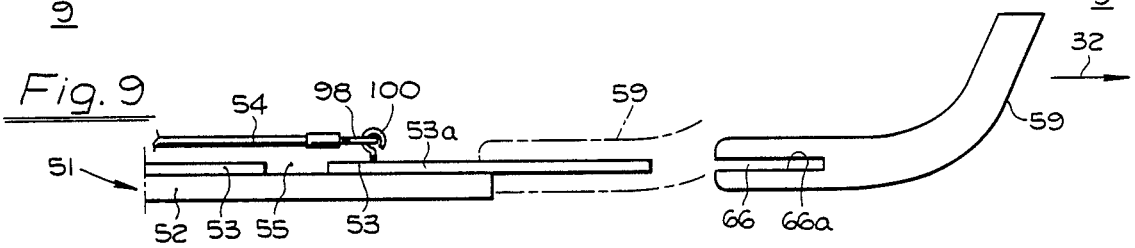
FIG. 9 is a side view, taken at line 9—9 of FIG. 8.
Figure 10:
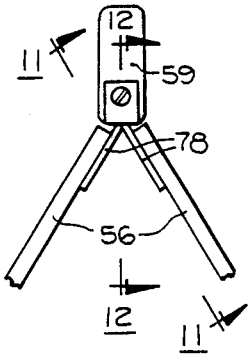
FIG. 10 is a fragmentary view looking down, at the extreme tip of the frame, at the stern.

FIGS. 8 and 9 together with FIGS. 3 and 6 show the specific construction of the keel 51. The spaces 55 between the floor boards accommodate the ribs, the connections between the keel and the ribs being described hereinbelow. The floor boards 53 include end boards, substantially identical to each other, one of which, 53*a*, is shown. The stem pieces 59, 60, are provided with slots 66, the one at the front being indicated 66*a*. The stem piece 59 is friction fitted to the front floor board 53*a* by fitting the end of the floor board into the slot, and the stem piece is held in perpendicular position, or vertically, and the stem piece is comfined laterally by the keel elements. These stem pieces 59, 60, are utilized for connecting certain of the longitudinal pieces of the frame.

Figure 11:
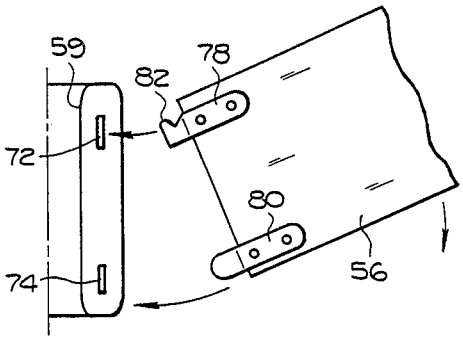
FIG. 11 is a view oriented generally according to line 11—11 of FIG. 10, but showing the gunwale in position just before being attached to the stem piece.
Figure 12:
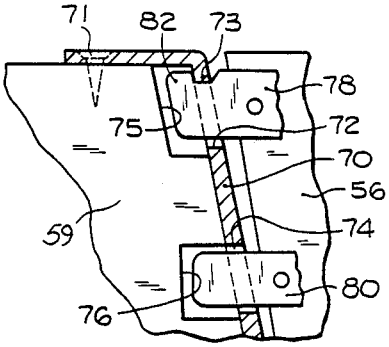
FIG. 12 is a view taken at line 12—12 of FIG. 10, showing the gunwale attached to the stem piece.

FIGS. 10–13 show the connection between the gunwales and the stern stem piece 59. A metal piece 70 is secured to the stem piece, as by screws 71, and has an upper slot 72 with an upper edge element 73, and a lower slot 74, the stem piece itself having recesses 75, 76, in register with the slots. Each gunwale has plates 78, 80, secured thereto at and extending beyond the end, the upper plate 78 having a hook 82 and the lower plate 80 being straight. The gunwale is fitted in place by tilting it upwardly as represented in FIG. 11, and then inserting the hook 82 under the element 73 and lowering the gunwale to a horizontal position, whereby the hook 82 hooks on the element 73 and the plate 80 slides into the lower slot 74. These two plates with their extensions secure the gunwales against movement in all directions in the final assembly of the frame, since the gunwale will be held down in horizontal position. The slots 72, 74, (FIG. 10) are sufficiently large to receive the plate elements on both of the gunwales in side-by-side relation.

The gunwales are secured to the stern step piece 60 in a similar manner, but in this case, as shown in FIGS. 13, 13*a*, the rear ridge rail 58 is connected in place therewith. A band 84, with a hook 86, is secured on the rear end of the ridge rail, and the hook is inserted into the slot 72, between the hooks on the gunwales. The front end of the rear ridge rail is then lowered, and it is secured in place as described hereinbelow.

The front ridge rail 57 at its front end is mounted on the gunwales, as shown in FIGS. 14–16. It is so mounted in conjunction with means for strengthening the frame at the extreme front end, to withstand the heavy pounding of the waves, and other forces. Mounted at the extreme end of the ridge rail, are a pair of brackets 88, one on each side, each having an outwardly extending arm 89. Mounted on each gunwale is a bracket 91 having an inturned top element 92, the latter having a downwardly extending element 93 at its inner end which is provided with a notch 94. The ends of the arms 89 are provided with slots 96 for receiving the elements 93. The ridge rail is held in forward position, whereby the corresponding element of the arm 89 is held in the notch 94, on each side of the kayak, and the interlock between the arms 89, and the brackets 91 is maintained. The structure, including particularly the arms 89, constitutes a transverse bar between the gunwales and reinforces them against inward pressure and movement. It will be noted that the front end of the ridge rail is spaced from the extreme front end of the frame, i.e. from the bow stem piece 59, thus enabling a sharp and narrow point at the front end of the kayak. The rear end of the front ridge rail 57 is secured to one of the ribs, adjacent the front end of the cockpit 42, as will be described hereinbelow.

The chines 54 are in the form of round rods, or dowels, each made up of sections secured together as shown in FIGS. 19–22 and described hereinbelow. They are secured at their ends to the floor boards on the upper sides of the latter, adjacent the ends of the keel. An eye screw 98 is screwed into each end of each chine, as shown in FIGS. 19 and 20, these eye screws being interconnected with similar eye screws 100 (FIGS. 8,9) in the end floor boards, one shown at 53*a*. The chines being thus secured at their ends, their mid portions are biased inwardly and engaged in notches 102 in the ribs (FIG. 23). In the disassembly of the frame, the ends of the chines remain connected with the floor boards.

In consideration of each of the main sections 46A, 46B, of the frame, it is pointed out that the longitudinal half-lengths are themselves separable into two increments of about equal lengths, either separable or hinged, and all together being capable of packing in bundles of about one-fourth the length of the kayak.

In so assembling the pieces of the frame, certain of the ribs 62 are assembled with the other pieces, as the assembly progresses.

As the assembly further progresses, following the connection of the keel and the gunwales with the stem piece, certain of the ribs 62 are put in place, being secured to both the keel and the gunwales, rigidifying the frame section. Later, after the frame sections are put in the hull, the last of the ribs are put in place. The ribs are generally similar in construction, but of different sizes and certain ones are discontinuous at the top to provide the cockpit 42. Each rib 62 (FIG. 3) includes a bottom element 104, side elements 105 rising therefrom, and in the case of certain ones, a top element 106, these elements surrounding a central opening 107 in the rib. In the case of those ribs throughout the length of the cockpit 42, portions of the top elements are cut out leaving short stubs 108 to which various ones of the elements of the coaming are secured.

FIGS. 24 and 25 show gunwale parts hinged together. As noted above, each section or half-length of the gunwales is made up of two parts 56*a* and 56*b* hinged together with suitable hinges 109. These hinges include plate elements 110 secured to the gunwale parts, as by riveting, and the hinge enables the two pieces to swing together about the axes 111 (FIG. 24) for folding, as indicated in FIG. 25.

The half-lengths of the keel are hinged in a manner similar to that of the gunwales. FIG. 17 is an enlarged fragmentary view of the floor boards, taken at the position of the arrow 17 in FIG. 2. This view includes a portion of the floor board 53*c*, and the adjacent one 53*d*. The keel elements 52 on the end floor board 53*c* are set closer than, and fitted inside of, those on the floor board 53*d*, and are hinged on a pin 112. The sections of the half-lengths are then folded as indicated by the arrows 114, to the position of FIG. 18, in which the elements are interfitted, and the floor boards are positioned flat and spaced apart only the thickness of a single keel element 52.

Reference is next made to FIGS. 19–22 for the detail construction of the chines 54 and the manner in which they are interconnected and detachable.

The chines, as in the case of the other longitudinal pieces, are made in half-lengths, and each half-length, referred to as a piece, is made up of two parts detachably interconnected. FIG. 19 shows the complete chine 54 made up of the half-lengths 116, 118, and each half-length made up of two parts 116*a*, 116*b*, and 118*a*, 118*b*. The two parts 116*a*, 116*b*, and 118*a*, 118*b*, are detachably interconnected by a connection 120 shown in large scale in FIG. 21, in exaggerated form. On one of the pieces, e.g. 116*a*, is a metal sleeve 122 staked as indicated diagrammatically at 124. The sleeve 112 may, instead, be interference-fitted, as indicated diagrammatically by the shoulder 126 or it may be secured both by staking and interference-fitting.

On the other chine part 116*b* is a sleeve 127 secured thereto as by staking indicated diagrammatically at 128. The sleeve 127 extends outwardly beyond the end of the chine part, and at that location it is counterbored to form an internal shoulder 129. The two sleeves, 122, 127, are dimensioned for high friction interfitting. The two parts are therefore detachably interconnected by fitting the sleeve 122 in the sleeve 127. The two parts together, when fitted end-to-end, are similar in length to the half-lengths of the keel and gunwales, and therefore together extend substantially half the length of the kayak, and in packing the pieces, in conformity with folding the gunwales and keel, the parts 116*b*, 118*a*, are separated and packed with the other loose pieces or parts.

In the progress of assembling the frame, the half-lengths of the chines are interconnected, as described above in the case of each main frame section 46A, 46B, in a connection shown in FIG. 22. In this connection, sleeves 130, 131, are placed on the adjacent dowel pieces, and a screw 132 having a smooth rounded head is driven through one sleeve into the dowel piece. The screw 132 is confined within a slot 133 in an outer slidable sleeve 134, with its head outwardly of and spaced from the outer sleeve, so that the outer surface of the outer sleeve, and the outer surface of the screw head remain relatively smooth and avoid possible puncturing of the hull. After the longitudinal pieces are so secured together, the ribs are put in place in the frame sections separately. In the case of each half section, 46A, 46B, the corresponding ribs, the two outermost, are interconnected in the corresponding main frame sections, and then those sections are put in the hull as described above the represented in FIGS. 4 and 5. After this last step, the final three central ribs are put in place.

Reference is made to FIGS. 26–31 for the securement of the ribs in the frame. The ribs are located in the spaces 55 between the floor boards and rest directly on the keel elements 52. Riveted to each rib, at the lower edge thereof, is an angle 133 (FIGS. 26–28) having a fork 134 (FIG. 28). The keel elements 52 on which the rib rests are shown and a headed screw 136 is secured in each keel element, and on each of the keel elements 52 is a swivel piece 138 pivotally mounted at 140. The mounting of the swivel piece 138 includes a finishing washer 139 next to the keel element, a wave washer 139*a* thereabove, and a lock washer 139*b* above the swivel piece, the latter being thereby frictionally held in position.

In assembling the rib, it is placed on the keel elements, between the swivel element and the screw 136, and moved in the direction of the screw, with the fork under the screw head and then the swivel element 138 is swung into locking position against the angle piece 133. It will be noted that one corner 141 of the swivel piece is rounded, to enable the swivel piece to be moved between locking and unlocking positions as indicated in dot-dash lines in FIG. 28.

The rib is secured to the gunwales at the side edges of the rib by means shown in FIGS. 29–31. The rib at its side edge preferably is concaved at 142 and an angle 143 is secured at that side edge with a leg 144 extending past the edge, and on the opposite side is a loop 146 secured as by riveting at 148 to the gunwale 56. A swivel piece 150, similar to the swivel piece 138, but without the finishing washer, is pivotally mounted on the gunwale and moved between a locking position shown in FIG. 30 and in solid lines in FIG. 29, and an unlocking position shown in dot-dash lines in FIG. 29.

The rib is connected with the gunwale in the same step as connecting it with the keel, and in doing so, the swivel piece 150 is moved to unlocking position, and the edge of the rib positioned between the locking piece and the loop 146, and then in moving it for connecting with the keel, it is also moved toward the loop 146, and the leg 144 enters into the loop. Thereupon the swivel piece of locking piece is moved to locking position against the angle 143.

Referring to FIG. 29, it is pointed out that the various pieces are so dimensioned and positioned that the upper edge of the gunwale, as indicated at 152, is above the upper edge 154 of the rib, so that the hull, when it is drawn taut over the frame, bears on the upper edge of the gunwale and not on the upper edge of the rib, as will be referred to again hereinbelow.

The mounting of the front ridge rail 57 at its front end and the rear ridge rail 58 at its rear end, were described above, and now attention is directed to FIGS. 3, 32–34, showing the mounting of the ridge rails at their other ends.

FIG. 32 is a fragmentary perspective view taken substantially at the position of the arrow 32 in FIG. 3, and FIG. 33 is taken substantially at line 33 of FIG. 32. Referring first to the front ridge rail 57 in Fig. 3, the rear end thereof, indicated at 154, is located under the coaming 48 as shown best in FIG. 32 and it closely approaches the corresponding rib 190 2. On the rear end of the front ridge rail is a bracket 156 having a U-shaped element 158 straddling the ridge rail and secured thereto, and having an upturned fork 160 (FIG. 34) in which is received the head of a rivet 162 mounted in the rib. A swivel lock 164 is pivotally mounted on the rivet and movable to an upper unlocking position shown in dot-dash lines, and when in that position, the end of the ridge rail is fitted in place by first springing it down and then moving it upwardly under the rivet and receiving the rivet in the fork. Then the swivel.lock 164 is permitted to drop and it swings downwardly under the bracket on the ridge rail as shown in full lines in FIG. 34, and holds the end of the ridge rail. The ridge rail is thus held against movement in all directions.

The front ridge rail 57 traverses the intermediate rib #1, and that rib is provided with a notch 165 (FIG. 35) into which the ridge rail is fitted, and the elements are so dimensioned and positioned that the ridge rail extends above the corresponding rib as indicated at 166. In this case also, the hull when drawn taut over the frame bears against the ridge rail, as well as the upper edges of the gunwales, as referred to above, and normally is held up from the ribs.

The rear ridge rail 58 is seen in its entirety (FIG. 3), and its front end is mounted on the corresponding rib #6 in the same manner as the mounting of the front ridge rail on the rib #2. Similarly the rear ridge rail is fitted in a notch as indicated at 167 (FIG. 3) in the corresponding rib #7, in the same manner as described in connection with FIG. 35.

Upon the following steps being completed, the two main sections 46A, 48B, are completed sufficiently for insertion into the hull. However it is pointed out that the middle ribs #3, #4, and 190 5, are not yet in the frame, and that the coaming is not yet in place.

After insertion of the main frame sections into the hull, the longitudinal pieces in the respective frame sections, at the center of the kayak, slightly overlap, and the gunwale and keel half-lengths are provided with connector means which also spread the frame sections longitudinally the additional slight amount required, for ramming them tightly into the hull. This also results in the respective longitudinal pieces being positioned in direct alignment.

Reference is made to FIGS. 36–38 for the connection of the half-lengths of the keel, which is adjacent the center of the length of the kayak. Floor boards 53*e*, 53*f*, are shown, the former having keel elements 52 with concave cylindrical recesses 168, and on the floor board 53*f* the keel elements have convex cylindrical end surfaces 169. The overlapping relationship is indicated in FIGS. 36, 37, where the two portions of the keel are necessarily at an angle. In interconnecting them, while at this angle, the convex end surfaces 169 are fitted in the concave recesses 168, and then the keel parts are pushed downwardly as indicated by the arrow 170 until they reach a longitudinal alignment shown in FIG. 38 where the floor board 53*e* rests on and against the keel elements on the other floor board. The keel is thus spread to its utmost position, and it is impossible for the parts thereof to spread any further and hence the curved elements 168, 169, have sufficient longitudinal extension to prevent dislodgement of the keel parts.

The ribs that are now to be put into place, #3, #4, and #5, are then put into position in the spaces 55 between the floor boards and fitted on the keel elements. At a later step they are connected with the keel and with the gunwales after the gunwales are interconnected.

For interconnecting the half-lengths of the gunwales, attention is directed to FIGS. 39–41. The gunwale pieces (half-lengths) are indicated at 56*a*, 56*b*, and on the former is a plate 171 which has a main flat portion 172 fitted to the gunwale and secured thereto as by riveting. The plate 171 extends beyond the end of the gunwale part forming a tongue 174.

Secured to the other gunwale piece 56*b* is a plate 176 spaced from the gunwale piece by spacers 178 and having an end portion 180 extending substantially beyond the end of the gunwale. A recess or notch 182 is formed at that point. In this case also, the plate 176 is preferably of channel form having flanges 184. The step of interconnecting the gunwale parts is indicated in highly exaggerated form in FIG. 39. In this step, the overlapping gunwale parts 56*a*, 56*b*, are pushed relatively inwardly of the kayak, forming an angle therebetween, with the tongue 174 in position to enter into the recess 182. The parts are then pushed outwardly in the direction indicated by the arrow 186 and in this step the tongue 174 so enters the recess 182, as shown in FIG. 40, and the extension 180 fits up flat against the plate 168. The flanges on the two plates provide added stability.

At this point both the keel half-lengths and the gunwale half-lengths are in interconnected condition, and then the #4 rib is put in place followed by the #3 and #5 ribs in the manner described above in connection with the other ribs. The ribs #2, #6, are placed in close proximity to the hinged junctures of the corresponding parts of the keel, as well as of the gunwales; as a further feature #4 is at, actually overlies, the main juncture, in solidifying the frame.

The coaming 48 is placed in position after the two main frame sections are inserted in the hull and the ribs and chines are in place. The coaming becomes a part of the frame, although it is applied in a later step. The edge of the opening 47 in the hull is secured to the coaming, and to the remainder of the frame, and the cockpit is thus formed. The coaming is secured to the ribs by means of brackets 188, located as indicated by the arrow 189 in FIG. 3 (center), and shown particularly in FIGS. 42–46. Each bracket 188 has a base portion 190 of U-shape fitted over the rib and riveted thereto at 192. It has an upstanding fork 194 with an upwardly opening slot 196, and preferably an edge flange.

The coaming 48 is made up of a plurality of lengths or pieces, as best shown in FIGS. 2 and 3. It includes two side lengths 198, 200, each of which is made up to two parts butted end-to-end, such as 198*a*, 198*b*, and correspondingly 200*a*, 200*b*, and it includes a transverse rear piece 202.

The two parts on one side, 198*a*, 198*b*, are interconnected as shown in FIGS. 44, 45. One of the parts, 198*b*, includes a bracket 204 riveted thereto with a male hook 206 positioned beyond the end of that part. The other part 198*a* has a similar plate, 208, secured thereto and provided with a female hook 210 positioned beyond the end of the part. To connect the parts, one of them, 198*a*, is first put at an angle relative to the other, as shown in dot-dash lines, and then moved up to place the hook 210 over the hook 206, as shown in solid lines. A plate 212 is secured to one part, and it overlies the other part, and is held in place by the normal pressure exerted on the connected parts as indicated by the arrow 214.

The two side pieces 198, 200, of the coaming are so shaped as to form a wide rear end (FIG. 3) and a pointed front end. The rear transverse piece 202 and each side piece are interconnected as shown in FIG. 46, where an angle bracket 216 is shown riveted to the piece 202, as indicated at 218, and it has a fork element 220 with a captivating recess 221. A bolt 222 extends through the corresponding side part 198*b*, and through a slot in the fork bracket, and the nut is tightened. The captivating recess receives the nut 223, thereby securing the two coaming pieces together against displacement in all directions.

FIG. 43 shows a coaming piece in cross section. It has a slot 226 in its upper edge, preferably with an outer side of the slot of greater length as indicated at 228. The edge of the hull 44 is indicated at 230, and bound to this edge is a beading 232. The hull is provided with a grommet 234 and a bolt 236 with a wing nut is mounted in the coaming piece and it remains there, but in loosened condition, when the parts are disassembled. To apply the coaming, the edge of the hull, which as shown in FIG. 43, rests on the rib 62, is drawn up over the inner surface of the coaming, and its edge inserted into the slot 226, and in taking this step, the inner end of the bolt 236 is extended through the grommet. Then the bolt is slid downwardly into the slot 196 (FIG. 42) in the bracket, and the wing nut on the bolt is tightened. This draws the coaming up against the bracket 188 and tightens the hull in place. This step is repeated at all of the brackets around the cockpit.

The brackets 188 are applied to the short stubs 108, FIGS. 3,6, in the case of ribs #3–#5. At the front end of the cockpit, while the coaming pieces come to a point, the hull need not follow around the point, but is applied under the front end thereof, up to the rib #2. At that rib, similar brackets, such as 188 of FIG. 43, are also applied.

The coaming is dimensioned so that the cross piece 202 at the rear is positioned rearwardly of the corresponding rib #6, so as to accommodate the positioning of a backrest on the rib, clear of the cross piece 202, as described hereinbelow. Similar brackets, as 188, are also used in mounting the rear ends of the pieces 198, 200, on the back rib #6.

The kayak includes two backrests 237 individually identified 237*a*, 237*b*, shown in FIGS. 3, 47, 48. The backrests are similar in overall construction and each includes a bar 238 and a cushion 239. In the case of the rear backrest 237*b*, it is permanently secured to the corresponding rib 62, #6, and therefore positioned slightly ahead of the rear coaming piece 202, as indicated above, and as shown in FIG. 2.

The front backrest 237*a* is detachably mounted, so as to mount it selectively in different positions. The means for so mounting this backrest is illustrated in FIGS. 47 and 48, which are oriented according to line 47—47 of FIG. 2. On the bar 238 of the backrest 237*a* is an angle bracket 240 having a fork 241 with an open end slot 242 which in the upright usable position of the backrest opens upwardly. In putting the backrest in place, the fork is inserted (FIG. 48) forwardly between the bracket element 194 and the adjacent hull element. It is then swung to operable position, with the cushion 239 vertical and thereafter the bolt 236 is tightened. The backrest can be mounted at either of the ribs 62, #4, or #5, so that when the kayak is to be occupied by two persons, the backrest is mounted at the rib #4, but when only one person occupies it, it is mounted at rib #5. At its front position, at rib #4, the two backrests are relatively positioned so that the weight of two occupants is properly distributed, and when only one person occupies it, with the backrest positioned at rib #5, his weight is also properly positioned, being more nearly the center of balance of the kayak, thus allowing for more proper stance of the kayak in the water. The two adjacent ribs, #4, #5, are of the same width and the segment of the hull, when applied between those ribs, is of uniform transverse dimension. More especially the sub pieces 108 of each of those two ribs, are uniformly spaced apart to accommodate the front backrest in either of those positions.

Another important feature of the invention is the incorporation in the kayak of accessory equipment. Attention is directed to FIGS. 49, 49*a*, showing stowage bags 248. The bags are a soft pack, of known kind, with flexible tie or mounting elements 249 at the sides. These stowage bags are designed to be carried on the back of a person with convenience, and additionally so that several of them can be carried by one person, with the bags hooked together, one above the other. FIG. 49*a* shows carrying straps 250 forming a strap system that can be secured to the person and bags secured thereto by the elements 249. The kayak includes provision for accommodating these stowage bags, detachably mounting them in the framework, and of course out of the way of the passengers. FIG. 49 shows such stowage bags mounted in the frame, with the hull omitted from the illustration to better shown them, this figure being oriented according to line 49—49 of FIG. 2.

The ribs are spaced apart longitudinally of the kayak at nearly equal intervals. The stowage bags are of a length to fit between adjacent ribs, and the frame includes hooks 251 for detachably mounting the bags in place. The bags may also be provided with tie straps 252 which are tied around the chines 54 for stability. The size and proportions of the kayak are such that four such stowage bags can be mounted on each side, making a total of eight stowage bags.

An important feature is that the placement of the keel and the chines, and their spatial interrelation, provide great stability, both initial and secondary. Those members provide the desired breadth at the bottom, and allow the ends to be formed in a relatively sharp V-shape.

The invention also encompasses a kayak having the foregoing features, with the additional feature of a "glass bottom", or transparent bottom, thus providing a window to observe the objects under the boat. In this case the "glass bottom" is provided by transparent plastic. The hull includes two main parts (FIGS. 50–52), one, part 254, or section below the water line (sometimes referred to simply as the hull), and the deck 256, or the upper part. In the present case the bottom part is made of transparent plastic and secured to the upper part in the usual seam construction.

There are various kinds of plastic material on the market; and one is clear poly vinyl chloride, selected for its flexibility and of a thickness similar to that of the standard opaque hull material.

For the "glass bottom" the wooden floor boards within the cockpit area are replaced with clear similarly dimensioned material with an anti-mar surface, thus allowing vision through the floor boards and through the clear hull below. FIG. 51 shows the floor boards, and both the floor boards and hull are shown to best advantage in FIG. 52. Certain of the other elements referred to above, in the first form of the kayak, are shown in FIG. 52 with the same reference numerals with 200 added, including the keel 251 as a whole, the keel elements 252, and the floor boards 253.

We claim:

1. A folding kayak wherein the following stated relationship between the elements thereof are determined by the position of the kayak in the water for use, the kayak comprising, a main frame and a hull, complementally shaped, and having a relatively broad beam and tapered to fore and aft ends of relatively sharp dimensions, the hull being of flexible material, having a top opening and being otherwise continuous, the main frame being separable at a position adjacent the middle longitudinally, forming fore and aft sections thereof, the main frame sections being insertable into the hull at the respective ends of the hull, and detachably connectible together, the main frame including logitudinal pieces extending nearly end-to-end of the main frame, stem pieces at the ends, and transverse ribs spaced longitudinally along the kayak, the frame having a cockpit and the top opening in hull being in register with the cockpit, and said longitudinal pieces including a keel, the stem pieces being separate from the remainder of the frame and fitted to the respective ends of the keel and when so fitted held against displacement transversely but freely removable endwise from the keel, and the stem pieces being held in fitted positions by the gunwales which are interconnected to the ribs, the keel including transversely spaced keel elements and floor boards above the keel elements, the stem pieces having open ended longitudinal slots, which engage the respective floor boards and are interfitted thereby, and when so interfitted they are at substantially right angles to each other.

2. A folding kayak according to claim 1 wherein the keel is made up of two half-lengths, one in each of said main frame sections, and each half-length is made up of parts hinged together on a transverse axis, the ends of the parts of the half-lengths adjacent the middle being swingable upwardly on the axes and swingable downwardly into an essentially co-planar position, wherein the keel elements on the adjacent parts have end elements interengageable at a position under one of the floor boards and have end surfaces respectively convex and concave about a transverse axis and having radial dimension sufficiently long to prevent separation of the respective positions of the keel elements in response to downward pressure when the half-lengths are held against separation longitudinally.

3. A folding kayak according to claim 2, wherein, in the case of each half-length, the parts are arranged with the keel elements on one part positioned between those of the other part, and all keel elements being aligned within the vertical projection of any one of the keel elements, and the keel elements on the adjacent parts being pivotally interconnected by a common hinge pin, and the parts being thereby foldable to a position in which the floor boards on the parts are parallel with the keel elements there-between and spaced apart a distance equal to the thickness of a single element.

4. A folding kayak according to claim 1 wherein, the longitudinal pieces include wooden gunwales, each made up of a pair of half-lengths, each gunwale including a connector inter-connecting the corresponding half-lengths, the half-lengths of each gunwale having a normal position in which the adjacent end portions of the half-lengths are springable inwardly from the normal position to a mutual obtuse angular position, the connector includes a pair of plates secured in flat face-to-face relationship to the respective half-lengths at the meeting edges of the latter, the half-lengths have male and female hooks movable to interconnected position when the half-lengths are in the angular position and retained in interconnected position when the half-lengths are moved to normal position, one of plates having an extension extending beyond the end of the respective half-length and interengageable with the other plate in flat face-to-face engagement when the half-lengths are in normal position, the plates together with the hooks preventing the adjacent ends of the half-lengths from being moved outwardly beyond the normal position, the respective plates having prongs and holes interengaged when the half-lengths are in normal position preventing relative vertical displacement between the plates.

5. A folding kayak according to claim 1 wherein the longitudinal pieces include a keel, chines, and gunwales, wherein, the longitudinaly pieces are made-up of half-lengths, and each half-length is made up of two parts, forming a plurality of joints in each longitudinal pieces, the longitudinal pieces engage and bear inwardly on the ribs, and the ribs are operable for stabilizing the parts in respective end-to-end relationship, the ribs have notches receiving the chines therein, and the chines have securement only with the floor boards at the ends of the chines and at the ends of the floor boards, and they are free of securement with the ribs and held in the notches and thereby in engagement with the ribs by inward biasing effect of the chines.

6. A folding kayak according to claim 5 wherein, eye screws are mounted in the ends of the chines and in the floor boards adjacent the ends of the latter, the chines having metal sleeves thereon at the extreme ends of the chines, the respective eye screws being interconnected and thereby providing said securement of the chines to the floor boards, the interconnected eye screws being normally so interconnected and thereby the respective end parts of the chines remain attached to the corresponding end parts of the keel.

7. A folding kayak according to claim 5 wherein the keel includes floor boards of substantial width, wherein, the chines, throughout their major central portions and except at their ends, are positioned transversely outwardly, and upwardly, from the side edges of the floor boards and thereby assist in determining the taper of the hull between the keel and the lower edge of the gunwales.

8. A folding kayak according to claim 1 wherein the longitudinal pieces include a keel, chines, and gunwales, wherein, the keel includes floor boards of substantial width, means for detachably connecting the ribs with certain of the longitudinal pieces against displacement of the ribs in all directions, and said connecting means including components provided at transversely spaced locations on the floor boards, and on the gunwales.

9. A folding kayak according to claim 8 wherein, the connecting means at each location on the floor boards includes a metal screw in the floor board having a head, an angle on the rib having a vertical back leg fitted to a first side of the rib and having a horizontal leg below the rib and extending beyond the opposite side of the rib with a fork formed in the extended end slidable under the screw head in straddling relation to the screw, and a swivel lock on the floor board at and spaced from the first side of the rib, swingable on a vertical axis into and out of a locking position in engagement with the vertical leg of the angle and thereby with the rib, the swivel lock having a rib-engaging end edge that is generally perpendicular to the length direction of the swivel lock but with a curved end portion accommodating swinging of swivel lock, and means for normally frictionally holding the swivel in position.

10. A folding kayak according to claim 8, wherein, each connecting means at each gunwale includes a loop on the gunwale, an angle on the rib having a transversely directed back leg fitted to a first side of the rib and a side leg at the side edge of the rib and extending into the loop, and a swivel lock on the gunwale at and spaced from the first side of the rib, swingable on a horizontal axis into a lower horizontal locking position in engagement with the back leg of the angle and thereby with the rib, the swivel lock being swingable vertically to an unlocking position, and the connecting means including stop means holding the swivel lock in locking position, the swivel lock having a rib-engaging end edge that is generally perpendicular to the length direction of the swivel lock but with a curved end portion accommodating swinging of the swivel lock, and means for normally frictionally holding the swivel in position, whereby tightening the bolts draws up and tightens the hull.

11. A folding kayak wherein the following stated relationship between the elements thereof are determined by the position of the kayak in the water for use, the kayak comprising, a main frame and a hull, complementally shaped, and having a relatively broad beam and tapered to fore and aft ends of relatively sharp dimensions, the hull being of flexible material, having a top opening and being otherwise continuous, the main frame being separable at a position adjacent the middle longitudinally, forming fore and aft sections thereof, the main frame sections being insertable into the hull at the respective ends of the hull, and detachably connectible together, the main frame including logitudinal pieces extending nearly end-to-end of the main frame, stem pieces at the ends, and transverse ribs spaced longitudinally along the kayak, the longitudinal pieces including gunwales assuming a generally horizontal position when the main frame is assembled, each gunwale being made up of a pair of half-lengths, and connectors detachably inter-connecting the half-lengths with the respective stem pieces, each half-length having a hook at a near end adjacent the stem piece, and the stem piece having a metal strip thereon with a first hole therein and a hook element at the top of the hole, the hook being insertable in the hole when the half-length is positioned with its remote end raised, and being hooked on the hook element when the remote end is thereupon lowered to horizontal position, whereby the gunwale is held against displacement in all directions, and the frame having a cockpit and the hull having an opening in register with the cockpit.

12. A folding kayak according to claim 11 wherein, the gunwales are of substantial vertical dimension, the hooks are adjacent the top of the gunwales, and the gunwales include longiitudinal tangs adjacent the bottom of the gunwales, and the metal strip on the stem piece includes a second hole below the first hole, and the tang on the gunwale enters into the second hole in response to the half-length being lowered to horizontal position.

13. A folding kayak according to claim 12 wherein, the stem pieces are relatively thin transversely and long longitudinally with inner narrow edges directed longitudinally toward each other, the stem pieces are of wood and in the case of each stem piece, the metal strip has a top element adjacent the horizontal secured to the top surface of the stem piece and downwardly extending vertical element secured to the inner edge surface of the stem piece, the vertical element is provided with said holes, the stem piece has recesses in register with the holes, the gunwales are of wood and the hook and tang are of metal and extend longitudinally beyond the gunwales.

14. A folding kayak wherein the following stated relationship between the elements thereof are determined by the position of the kayak in the water for use, the kayak comprising, a main frame and a hull, complementally shaped, and having a relatively broad bearm and tapered to fore and aft ends of relatively sharp dimensions, the hull being of flexible material, having a top opening and being otherwise continuous, the main frame being separable at a position adjacent the middle longitudinally, forming fore and aft sections thereof, the main frame sections being insertable into the hull at the respective ends of the hull, and detachably connectible together, the main frame including logitudinal pieces extending nearly end-to-end of the main frame, stem pieces at the ends, and transverse ribs spaced longitudinally along the kayak, the frame having a cockpit and the hull having an opening in register with the cockpit, and each rib including a bottom element, side elements, and a top element surrounding a central hole, in the case of a group of successively adjacent ribs near the mid-point longitudinally of the kayak, the top element being discontinuous forming stubs at the sides directed transversely inwardly and the stubs together forming the cockpit, and in the case of the remaining ribs fore and aft of the cockpit the elements being continuous.

15. A folding kayak according to claim 14 wherein, the main frame includes front and rear ridge rails, each connected at a first end to a rib at the corresponding end of the cockpit and connected at the other end to the main frame adjacent the ends of the latter, the ridge rails overlaying and engaging the corresponding continuous ribs, and connecting means is provided for detachably connecting said first ends of the ridge rails to the corresponding ribs, each connecting means including a horizontal headed rivet mounted in the rib, a band on the end of the ridge rail having an end element spaced longitudinally beyond the ridge rail with an upwardly opening slot therein and insertable upwardly behind the rivet head in straddling relation to the rivet, and a swivel lock on the rib swingable on a horizontal axis and having a horizontal leg on its swinging end, and movable by gravity to lower locking position in which the horizontal leg is below the ridge rail in holding position relative thereto.

16. A folding kayak according to claim 14 wherein, the main frame includes front and rear ridge rails, each connected at a first end to a rib at the corresponding end of the cockpit and connected at the other end to the main frame adjacent the ends of the latter, the ridge rails overlying and engaging the corresponding continuous ribs, and connecting means is provided for detachably connecting the rear ridge rail and the gunwales at their rear ends to the stem piece at the rear, forming a plurality of members so connected, the connecting means including a recess in the stem and a hook element at the top of the recess and a hook on each of said members extending longitudinally beyond the respective members, connection being effected by elevating the fore ends of the members and inserting the hooks into the recess and then lowering the members, whereby the hooks operably engage the hook element.

17. A folding kayak according to claim 14 wherein, connecting means is provided for detachably connecting the front ridge rail at its front end to the main frame at the front end of the latter, the connecting means including laterally outwardly extending bars on the ridge rail engaging the gunwales at a position spaced from the front end of the main frame, the bars also forming means bracing the gunwales against inward movement.

18. A folding kayak wherein the following stated relationship between the elements thereof are determined by the position of the kayak in the water for use, the kayak comprising, a main frame and a hull, complementally shaped, and having a relatively broad beam and tapered to fore and aft ends of relatively sharp dimensions, the hull being of flexible material, having a top opening and being otherwise continuous, the main frame being separable at a position adjacent the middle longitudinally, forming fore and aft sections thereof, the main frame sections being insertable into the hull at the respective ends of the hull, and detachably connectible together, the main frame including logitudinal pieces extending nearly end-to-end of the main frame, stem pieces at the ends, and transverse ribs spaced longitudinally along the kayak, the frame having a cockpit and the hull having an opening in register with the cockpit, and coaming surrounding the cockpit made up of a plurality of circumferentially continuous pieces including a transverse rear piece and side pieces extending forwardly and merging into a common point, and means connecting the coaming to the ribs each including U-shape bracket straddling the rib and a finger extending upwardly therefrom, the fingers being positioned inwardly of the coaming piece, toward the cockpit, the marginal edge of the opening of the hull being positioned between the fingers and the coaming piece, and bolts extending through the finger and coaming piece tightly securing them together and securing the edge of the hull therebetween.

19. A folding kayak according to claim 18 wherein, the finger is channel shaped with a concave side directed inwardly toward the cockpit and having an upwardly open slot, the bolt having a head and being normally retained in a hole in the coaming piece, the hull having a grommeted hole receiving the bolt head therethrough, and the bolt being fitted in the slot in the finger, with the head engaging the finger on the concave side, and the coaming having a groove receiving the marginal edge of the hull around said opening therein, whereby tightening the bolts draws up and tightens the hull.

20. A folding kayak according to claim 18 wherein, the coaming includes a back piece and a pair of side pieces, the back piece is transversely positioned and connected at its ends to the rear ends of the side pieces, and the front ends of the side pieces are positioned together in a point, the coaming is mounted in the frame by securing the side pieces to the ribs to the exclusion of the back piece being secured to the ribs and the back piece is mounted only by securement to the side pieces, the coaming includes connector means for so securing the back piece to the side pieces, each connector means includes an angle having a first leg secured to the back piece, and a slotted second leg having a recess and fitted to the corresponding side piece and a bolt extending through the side piece and fitted in the slot in the second leg.

21. A folding kayak according to claim 20 wherein, each side piece of the coaming includes a pair of parts and hinge means connecting them together, the hinge means includes a small plate on each part with a hook extending beyond the end of the part and within the projection of the flat sides of the part, the hooks being operably interengageable in response to placing the parts at a mutual obtuse angle and fitted together and again placing them in straight end-to-end relation, one of the parts having a large plate secured to one of the parts and extending over the end position of the other parts, the connector means include means for releasably securing the large plate to the other part.

22. A folding kayak wherein the following stated relationship between the elements thereof are determined by the position of the kayak in the water for use, the kayak comprising, a main frame and a hull, complementally shaped, and having a relatively broad beam and tapered to fore and aft ends of relatively sharp dimensions, the hull being of flexible material, having a top opening and being otherwise continuous, the main frame being separable at a position adjacent the middle longitudinally, forming fore and aft sections thereof, the main frame sections being insertable into the hull at the respective ends of the hull, and detachably connectible together, the main frame including longitudinal pieces extending nearly end-to-end of the main frame, stem pieces at the ends, and transverse ribs spaced longitudinally along the kayak, the frame having a cockpit and the hull having an opening in register with the cockpit, and the cockpit extending longitudinally over a plurality of ribs, and at least certain of those ribs being cut out at the top to form the cockpit, and a whole rib adjacent the rear end of the cockpit having a continuous top element, a pair of backrests in the cockpit, a rear one of which being permanently mounted on the whole rib, and connector means detachably mounting the front backrest selectively at different positions adjacent corresponding cutout ribs.

23. A folding kayak according to claim 22 wherein, the kayak includes coaming surrounding the cockpit, an angle having a first leg secured to the backrest and a second leg with an open ended slot extending upwardly when the backrest is in vertical position, the fork being positioned between the coaming and the edge of the hull surrounding the cockpit, and means for securing the second leg in place, and operable therewith for tightening the hull to the coaming at that location.

24. A folding kayak according to claim 22, wherein, the cockpit is narrower than the portion of the kayak in which it is positioned, leaving side spaces within the hull and outwardly beyond the side limits of the cockpit, and stowage bags detachably mounted in said side spaces between respectively adjacent ribs.

25. A folding kayak according to claim 24 wherein, the stowage bags are flexible, and have connector elements at the upper corners, and the kayak has connector elements at adjacent ribs operably cooperating with the connector elements on the stowage bags, whereby to enable a user to connect to a strap system to interconnect a single or plurality of the stowage bags in a vertical series for carrying them personally on the back as a single fanny pack, or plurally, a soft backpack.

26. A folding kayak wherein the following stated relationship between the elements thereof are determined by the position of the kayak in the water for use, the kayak comprising, a main frame and a hull, complementally shaped, and having a relatively broad beam and tapered to fore and aft ends of relatively sharp dimensions, the hull being of flexible material, having a top opening and being otherwise continuous, the main frame being separable at a position adjacent the middle longitudinally, forming fore and aft sections thereof, the main frame sections being insertable into the hull at the respective ends of the hull, and detachably connectible together, the main frame including longitudinal pieces extending nearly end-to-end of the main frame, stem pieces at the ends, and transverse ribs spaced longitudinally along the kayak, the frame having a cockpit and the hull having an opening in register with the cockpit, and the hull being a single unitary piece, made of flexible material throughout, completely covering the main frame except for the cockpit, and including bottom portion that is constituted by said flexible material, and thereby itself being entirely of flexible material, and is transparent and thereby forms a window for the occupant.

27. A folding kayak according to claim 26, wherein, the transparent bottom portion constitutes a lower section of the hull below the water line, and the hull includes an upper opaque section above the water line, the two sections being secured together in a unitary article.

28. A folding kayak according to claim 26 wherein, the keel includes floor boards of substantial width and length, and the floor boards are of transparent material, at positions substantially in register with the cockpit.

* * * * *